US005220541A

United States Patent [19]

Vuilleumier

[11] Patent Number: 5,220,541

[45] Date of Patent: Jun. 15, 1993

[54] WATCH MOVEMENT HAVING A CHRONOGRAPH MODULE ADAPTED ON A MOTOR MODULE

[75] Inventor: Cyril Vuilleumier, Bienne, Switzerland

[73] Assignee: ETA SA Fabriques d'Ebauches, Switzerland

[21] Appl. No.: 956,050

[22] Filed: Oct. 2, 1992

[30] Foreign Application Priority Data

Oct. 14, 1991 [CH] Switzerland ..... 03010/91

[51] Int. Cl.[5] ..... G04B 37/00; G04F 8/00

[52] U.S. Cl. ..... 368/88; 368/110; 368/113

[58] Field of Search ..... 368/88, 110–113, 368/276, 157, 160, 76, 80

[56] References Cited

U.S. PATENT DOCUMENTS 3,543,506 12/1970 Dubois et al. ..... 58/74
4,623,261 11/1986 Muto ..... 368/80
5,113,382 5/1992 Bron ..... 368/106

FOREIGN PATENT DOCUMENTS 2176158 10/1973 France .
515535 11/1971 Switzerland .
647125 1/1985 Switzerland .

*Primary Examiner*—Vit W. Miska
*Attorney, Agent, or Firm*—Pollock, Vande Sande & Priddy

[57] ABSTRACT

A watch movement is a combination of a chronograph module and a motor module, the motor module comprising a third wheel, a first power take off composed of a toothed wheel fixed to the cannon-pinion and a second power take off composed of a pinion fixed to the seconds axle in the center, the chronograph module having a chronograph hand, a hand for the minute counter and a hand for the hour counter. This watch movement also has a third power take off composed of a wheel fixed to the third wheel, these three power take offs being accessible from the same side by the upper face of the motor module and the chronograph module being placed against said upper face of the motor module, and in that the hand of the chronograph, the hand of the minute counter and the hand of the hour counter are driven respectively and in independent manner by said second, third and first power take offs.

5 Claims, 17 Drawing Sheets

WATCH MOVEMENT HAVING A CHRONOGRAPH MODULE ADAPTED ON A MOTOR MODULE

FIELD OF THE INVENTION

The instant invention relates to a chronograph module adapted to be mounted on a watch movement or conventional motor module. The invention also relates to a chronograph watch provided with a chronograph module of this type.

In order to rationalize the manufacture of chronograph watches, it may be desirable to use a conventional motor module or an only slightly modified module and to add thereto a chronograph module which can easily be mounted on this motor module.

DESCRIPTION OF THE PRIOR ART

Swiss patent CH 647 125 describes a chronograph watch constructed on this principle. In this watch, the drive of the chronograph module is effected by two concentric power take offs from the motor module. Display of the actual time (hour hand and minute hand) is controlled by a first power take off consisting of the cannon-pinion of the motor module, whereas the display of the time elapsed (central second hand, minute and hour hands) is controlled by a second power take off composed of the seconds axle in the centre of the motor module. In other words, the gear-train of the chronograph is constructed according to a system termed "in series", where a single power take off (the second) makes it possible to effect all the functions of the chronograph.

However, this type of assembly has substantially two disadvantages.

Firstly, there is a loss of amplitude of the balance. This is due to the fact that the second power take off has to drive numerous wheels and is therefore very sensitive to all losses due to friction which accumulate in a series of gear trains. The last wheels of this gear train in series risk losing speed and there is a risk that the display of the minute and hour counters becomes impaired.

Secondly, in mass production, it is necessary to make very many adjustments during assembly of the parts. The different gear trains of the second, minute and hour counters need to be adjusted in relation to one another.

It is an object of the invention to overcome these disadvantages.

BRIEF SUMMARY OF THE INVENTION

The invention relates to a watch movement comprising a combination of a chronograph module and a motor module, the motor module comprising a third wheel, a first power take off composed of a toothed wheel fixed to the cannon-pinion and a second power take off composed of a pinion fixed to the axle of the seconds axle in the centre, the chronograph module comprising a chronograph hand, a minute counter and an hour counter.

According to the particular features of the instant invention, this watch movement comprises a third power take off composed of a wheel fixed to the third wheel, these three power take offs being accessible from the same side by the upper face of the motor module and the chronograph module being placed against said upper face of the motor module and in that the hand of the chronograph, the minute counter and the hour counter being driven respectively and in independent manner by said second, third and first power take offs.

As a result of these features of the invention, different gear trains of the invention are driven in parallel, making it possible to improve the accuracy of the display of time on the counters, to reduce losses in amplitude of the balance and to limit adjustments.

In addition, according to other features of the invention, the watch movement comprises a first disconnecting-gear lever for the hub of the chronograph, a second disconnecting-gear lever for the minute hand and a third disconnecting-gear lever for the hour hand, these three levers being controlled by a single part acting as a coupling control.

The three counters of seconds, minutes and hours are engaged or stopped simultaneously, thereby avoiding any angular time-lag at the end of the series of gear trains.

BRIEF DESCRIPTION OF THE DRAWINGS

The invention will be better understood from study of the following description of a preferred embodiment given as a non-limiting example and of the appended drawings in which.

In the following description, the terms 3 o'clock, 6 o'clock, 9 o'clock, 12 o'clock, top, bottom, upper and lower are used with reference to a chronograph seen from above, i.e. seen from the face side.

DETAILED DESCRIPTION OF THE INVENTION

Figure 1:
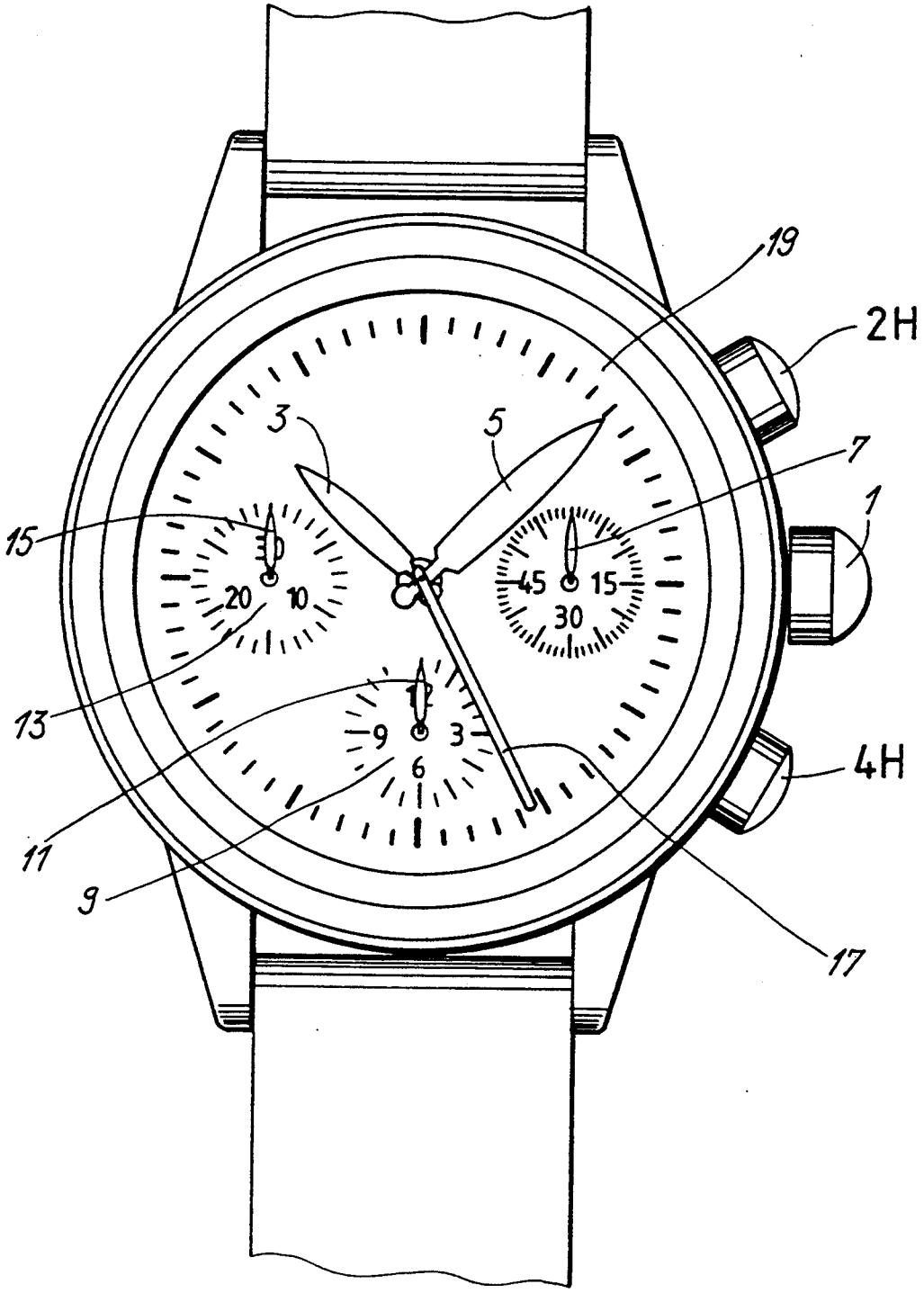
FIG. 1 shows a plan view of a chronograph watch incorporating a combined construction according to the invention.

As shown in FIG. 1, the watch movement according to the invention constitutes according to one embodiment a chronograph watch. This comprises in conventional manner a winding crown 1, a first push button 2H controlling the starting and stopping of the chronograph and located substantially at 2 o'clock and a second push button 4H controlling the return to zero of the chronograph and arranged substantially at 4 o'clock. This watch makes it possible to display the actual time with the aid of an hour hand 3, a minute hand 5 and a small second hand 7 arranged at 3 o'clock. It also makes it possible to display the time lapsed by means of a twelve-hour counter 9 located at 6 o'clock and provided with a hand 11, of a thirty-minute counter 13 located at 9 o'clock and provided with a hand 15, and of a central chronograph second hand 17. For reasons of simplicity, the twelve-hour counter 9 and the thirty-minute counter 13 will be referred to hereafter as hour counter 9 and minute counter 13. The graduations of these different counters are shown on a dial 19. It will be noted that the hour counter 9 has intermediate graduations making it possible to display the half hour between each of the 12 hour graduations.

Figure 2:
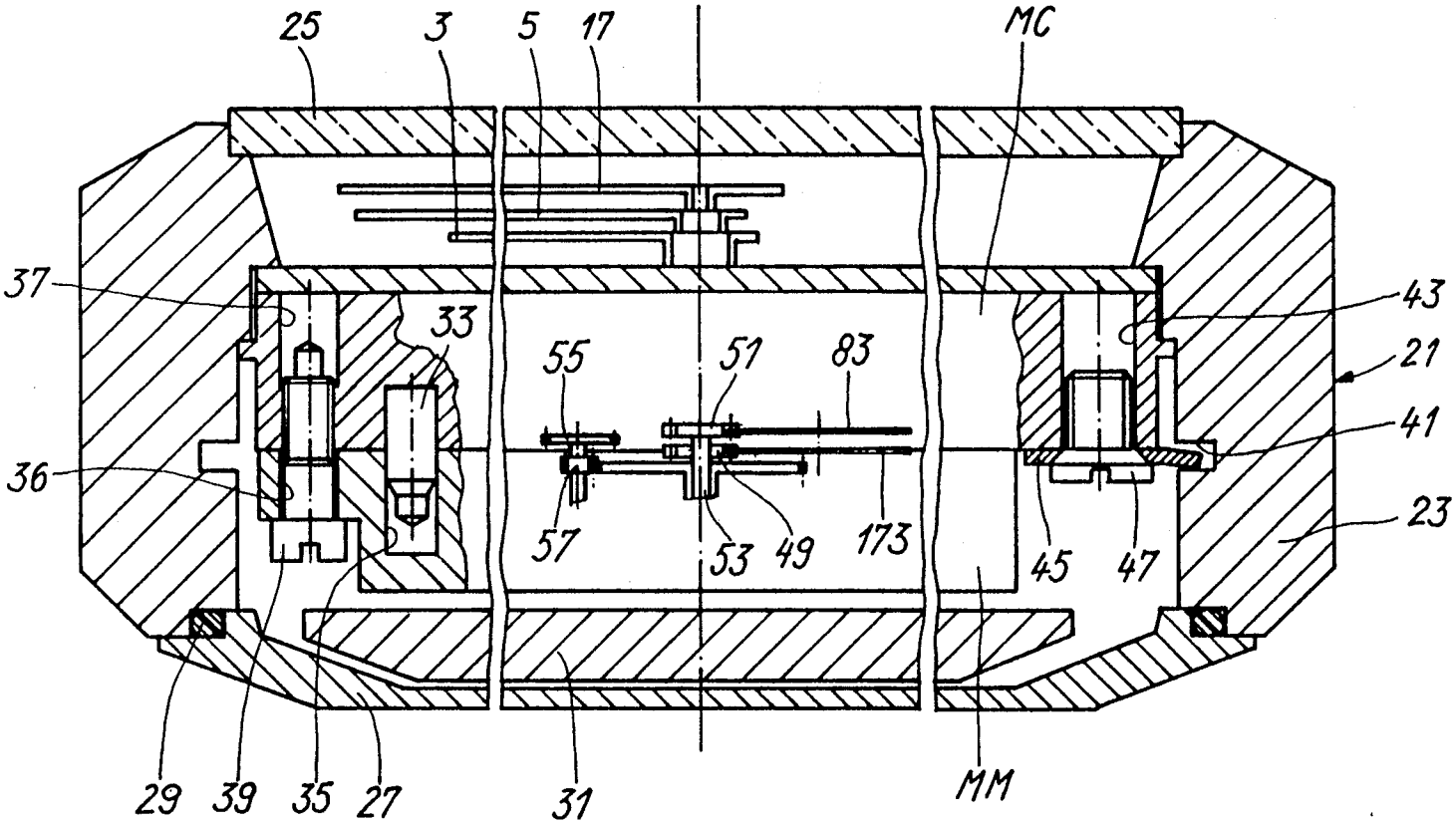
FIG. 2 shows an axial sectional view illustrating the assembly principle of the chronograph module of the invention on the motor module.

FIG. 2 is a diagram illustrating how the two modules constituting the chronograph watch are matched together. Some parts of the watch have been enlarged to clarify this FIG. 2 and the dimensions are not always to scale.

This watch comprises a motor module MM and a chronograph module MC assembled inside a watch case 21. In conventional manner, this watch case 21 has a case band 23 to which are fitted a glass 25 and a back 27. A sealing gasket 29 is disposed between the case band 23 and the back 27. This structure is naturally only given by way of example and the invention is not limited thereto. In the embodiment shown, the motor module is mechanical and with automatic winding. It thus has an oscillating mass 31. It would, however, also be possible to use a quartz motor module.

The chronograph module MC has two pins 33 (only one being shown in FIG. 2) in its lower part. Each substantially cylindrical pin 33 is designed to be engaged in an orifice 35 provided in the upper part of the motor module MM. These two pins 33 serve to angularly position the two modules in relation to one another. One will notice that each pin comprises a guiding point, the diameter of which is smaller than the main diameter of the pin in order to facilitate the introduction of the teeth during the fitting of the chronograph module MC onto the motor module MM.

In addition, the motor module MM and the chronograph module MC are each provided on their periphery with three holes 36, respectively 37 (only one pair of holes is shown in FIG. 2), the holes 37 being partially tapped. Three screws 39 are engaged in these holes 36, 37 to permit assembly of the two modules.

The assembly of these two modules is fixed inside the watch case 21 in the following manner. The case band 23 has an annular recess 41 on its inner face. The chronograph module MC has on its periphery three supplementary tapped holes 43 (only one is shown in FIG. 2). Opposite each of these holes 43 a casing clamp 45 is fixed to the lower face of the chronograph module MC by means of a screw 47 screwed into the hole 43. After assembly, this casing clamp 45 exceeds the diameter of the chronograph module MC and engages inside the annular recess 41.

The motor module MM is slightly modified as compared with a conventional watch movement in that it comprises, instead of hands, a toothed wheel 49 fixed to the cannon-pinion of this module and constitutes a first power take off, a pinion 51 fixed to the seconds axle 53 in the centre and constituting a second power take off coaxial to the first and a toothed wheel 55 fixed to the third wheel 57 and constituting a third power take off.

The gear train assembly is actuated by these three power take offs 49, 51, 55 according to a system termed "in parallel" which will now be explained in greater detail.

Figure 3:
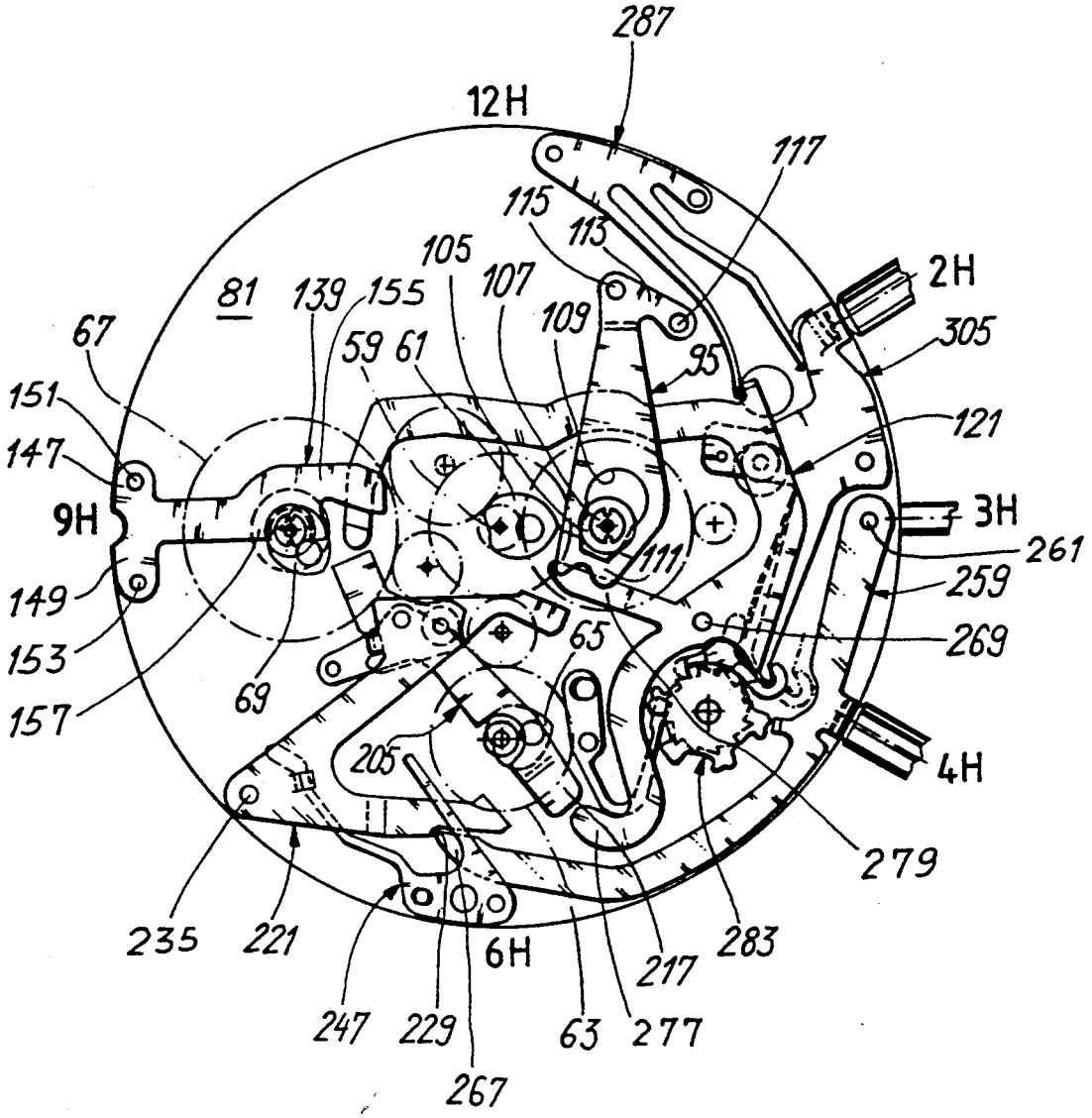
FIGS. 3, 4, 5 show plan views of the chronograph module in the positions of working, stopping and returning to zero respectively.
Figure 4:
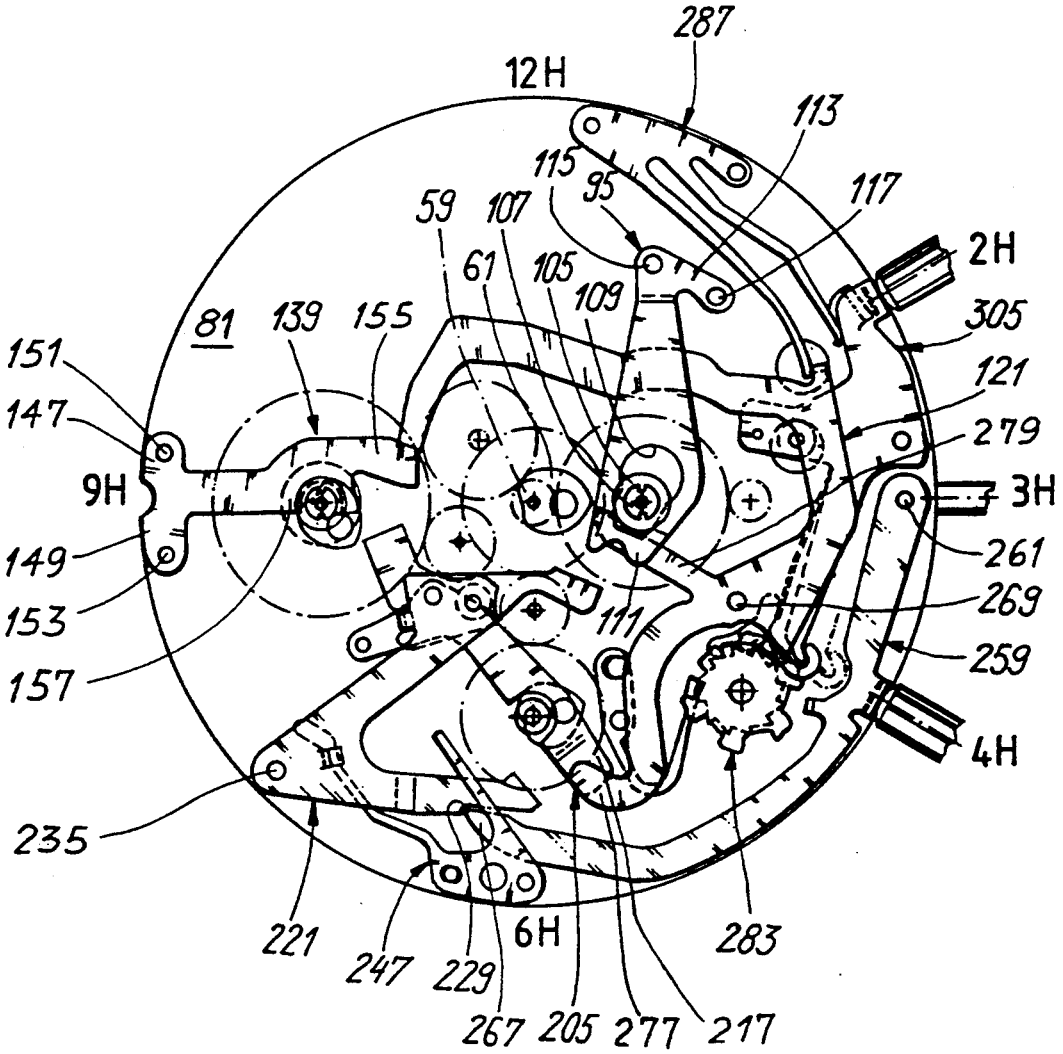
Figure 5:
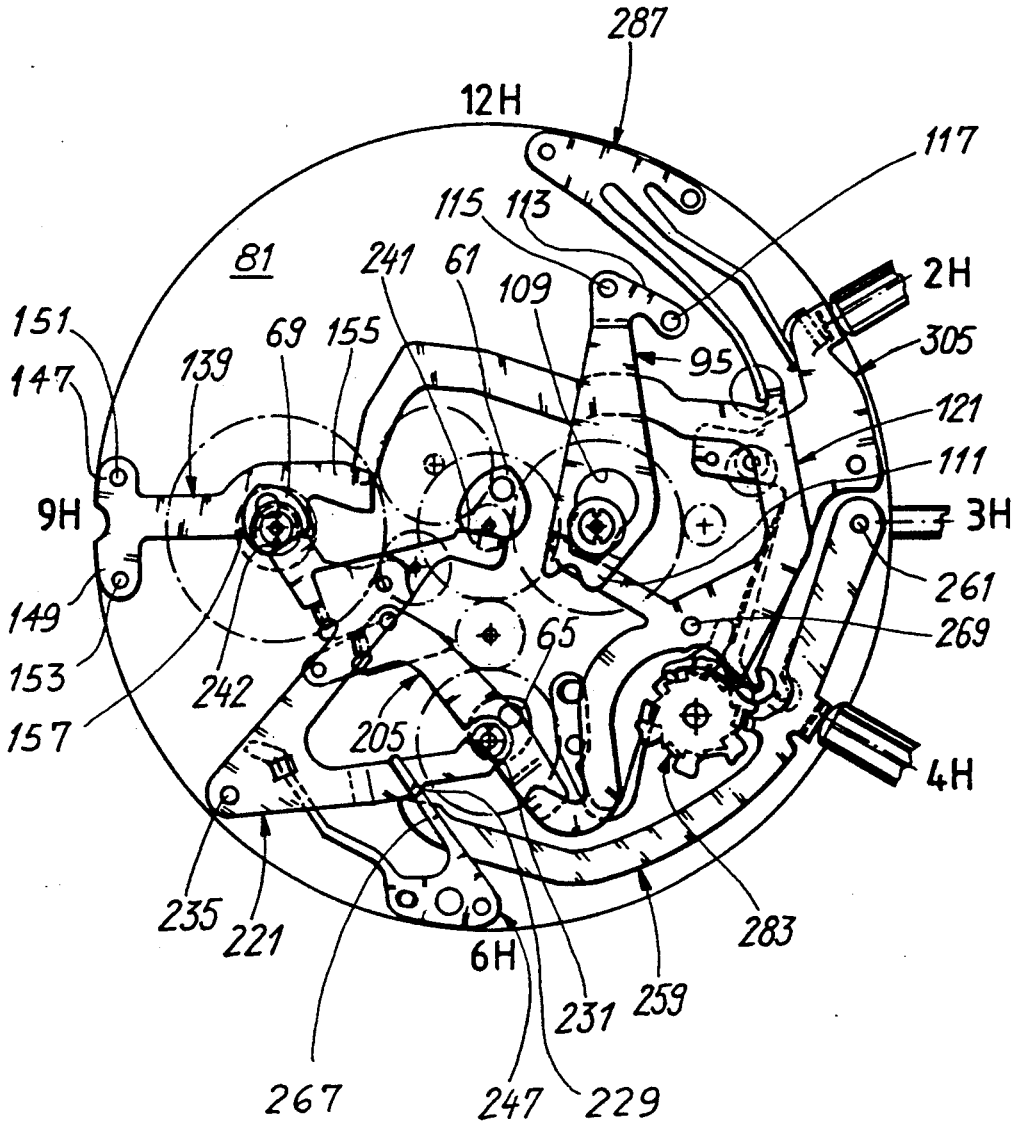

FIGS. 3, 4 and 5 illustrate plan views of the chronograph module MC in which the wheels are merely indicated by dotted lines and the dial and the hands have been omitted.

As shown in FIGS. 3, 4 and 5, the chronograph module MC has in conventional manner in its centre a chronograph wheel 59 provided with a heart-piece 61. It also comprises on the periphery, at 6 o'clock and at 9 o'clock respectively, a wheel 63 of the hour counter provided with a heart-piece 65 and a wheel 67 of the minute counter provided with a heart piece 69.

Figure 11:
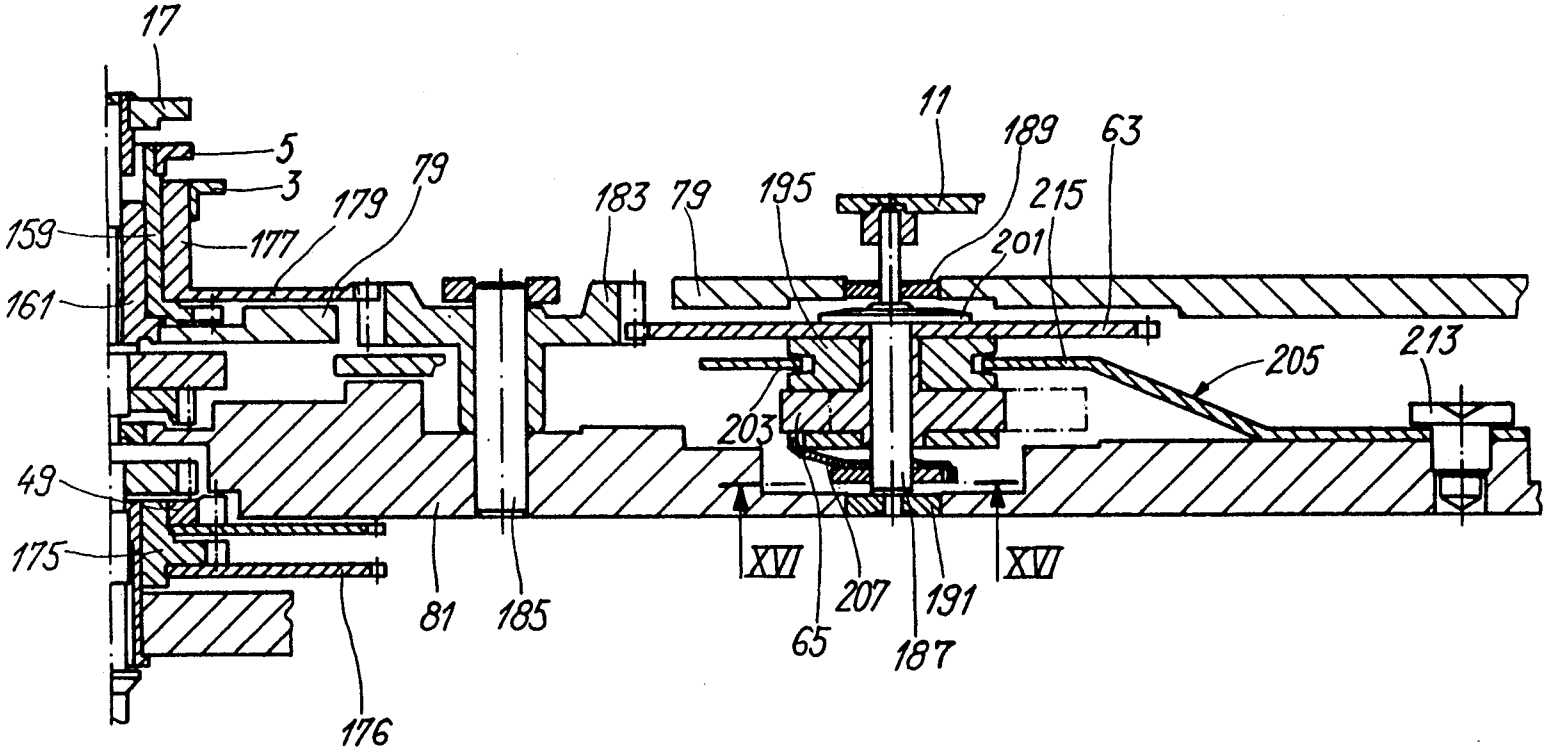
FIGS. 11 and 12 are sectional views along the line XI—XI of FIG. 15, showing respectively two extreme positions which can be occupied by a coupling wheel.

The heart-pieces 61 and 69 (FIGS. 6 and 8) are arranged respectively above the chronograph wheel 59 and the wheel 67 of the minute counter wheel 67. In contrast, the heart-piece 65 is arranged underneath the wheel 63 of the hour counter (FIG. 11).

Figure 6:
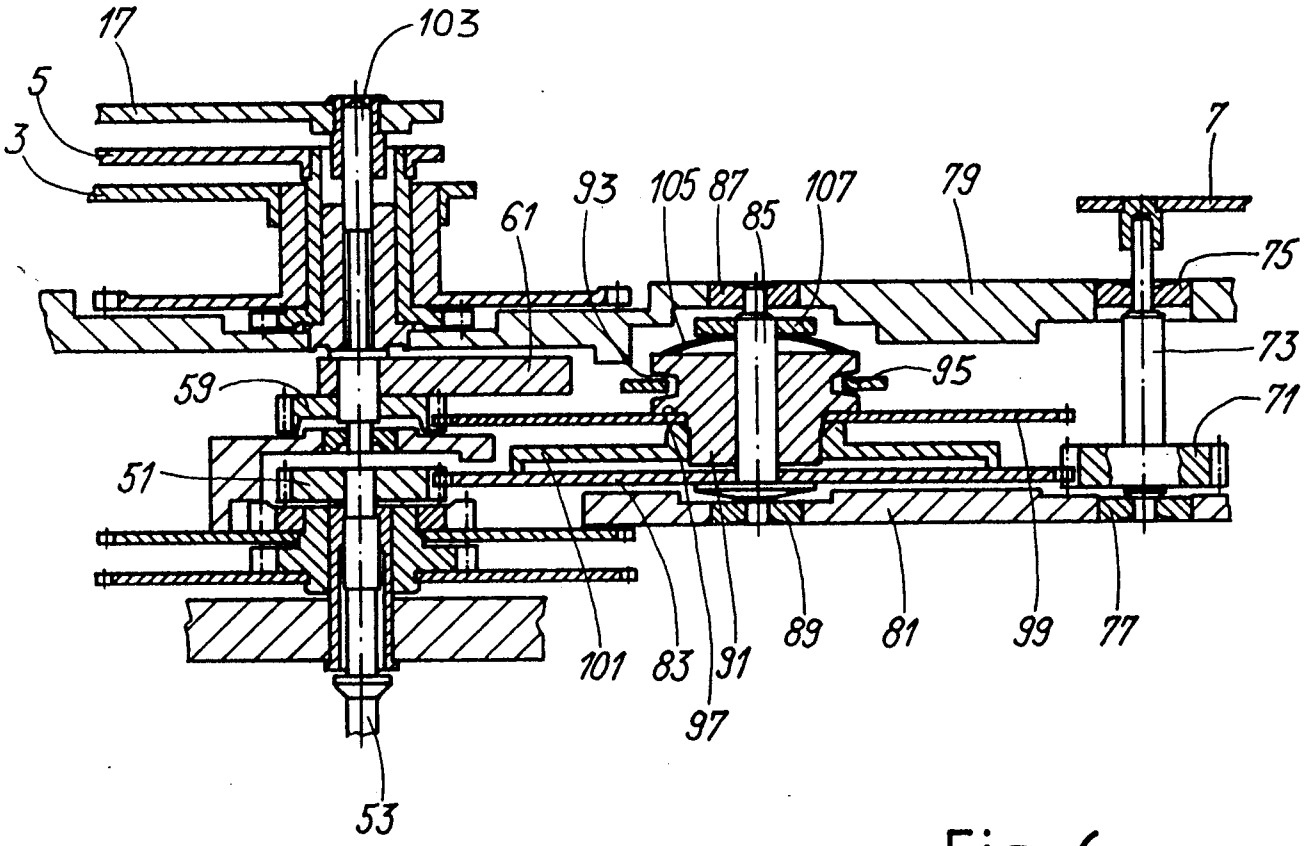
FIGS. 6 and 7 are sectional views along the line VI—VI of FIG. 13 showing respectively two extreme positions capable of being occupied by one coupling wheel.

As explained hereinabove, the watch movement does not have, for the display of the actual time, indications of the second in the centre, but this display is effected by means of the small second hand 7 arranged at 3 o'clock and driven by a small second wheel 71 (FIG. 6). This small second wheel 71 is fixed to an axle 73 mounted in an upper bearing 75 and a lower bearing 77. The upper bearing 75 is mounted in the chronograph bar 79, whereas the lower bearing 77 is mounted in the chronograph plate 81.

The small second hand 7 is driven onto the axle 73.

The small second wheel 71 is driven from the seconds axle 53 in the centre by the pinion 51 constituting the second power take off and by an intermediate seconds wheel 83 revolving freely about an axle 85 mounted on bearings 87 and 89 which are in turn driven into the chronograph bar 79 and into the chronograph plate 81 respectively.

The second power take off 51 is located directly below the chronograph wheel 59. If a mechanical lever motor module is used, the wheels 51 and 71 turn by one step per oscillation of this balance. In the case of a quartz motor module, they turn for example by one step per second.

The above-described wheels 51, 59, 63, 67, 71, 83 and the heart-pieces 61, 65, 69 are conventional and the man skilled in the art of watchmaking will be able to manufacture and assemble them without the need for a further description herein.

A chronograph hub 91 is arranged above the intermediate seconds wheel 83 and coaxially thereto and has an annular recess 93 serving as an engaging groove for an uncoupling lever 95 to be described hereinbelow. Halfway up this hub 91 is an annular shoulder 97 against which rests a coupling wheel 99 surmounting a coupling ring 101. The hub 91 is able to slide along the axle 85 so as to occupy two positions.

In the engaged position (lower position shown in FIG. 6) the coupling ring 101 comes into contact with the intermediate seconds wheel 83 which drives it in rotation by friction and this ring 101 transmits this rotatory movement to the coupling wheel 99 which meshes with the chronograph wheel 59. As a result thereof, in the engaged position, the chronograph wheel 59 turns at the same speed as the wheel 51 constituting the second power take off. The chronograph wheel 59 is driven onto an axle 103 which carries the central second hand of the chronograph 17. The latter is thus driven at the rhythm of the axle 53 which constitutes the outlet of the motor module MM.

In the unengaged position (upper position shown on FIG. 7), the coupling ring 101 is disengaged from the intermediate seconds wheel 83, but the coupling wheel 99 remains engaged with the chronograph wheel 59.

The coupling wheel 101 is permanently urged against the intermediate seconds wheel 83 as a result of the action of a resilient washer 105 fixed to a platform 107 driven onto the axle 85. This resilient washer 105 exerts pressure on the top of the hub 91 in the direction of the coupling, opposite to the action exerted, if such should be the case, by the lever 95.

As shown in FIGS. 3 to 5, and notably 13, the uncoupling lever 95 is substantially elongated in shape and has at one of its extremities an oblong orifice 99 above which there extends an upwards directed inclined plane 111. This lever 95 has at its other extremity a lateral fixing bracket 113 and it is fixed to the chronograph plate (not shown) by two catches 115, 117. The contour of the oblong orifice 109 has two opposing catches 119 (FIG. 13) designed to penetrate the engagement groove 93 of the hub 91 (FIG. 6) thereby making it possible to displace this vertically.

The vertical displacement of the free extremity of this uncoupling lever 95 is ensured by an uncoupling control 121 which will be described hereinbelow and which acts on the inclined plane 111.

Figure 8:
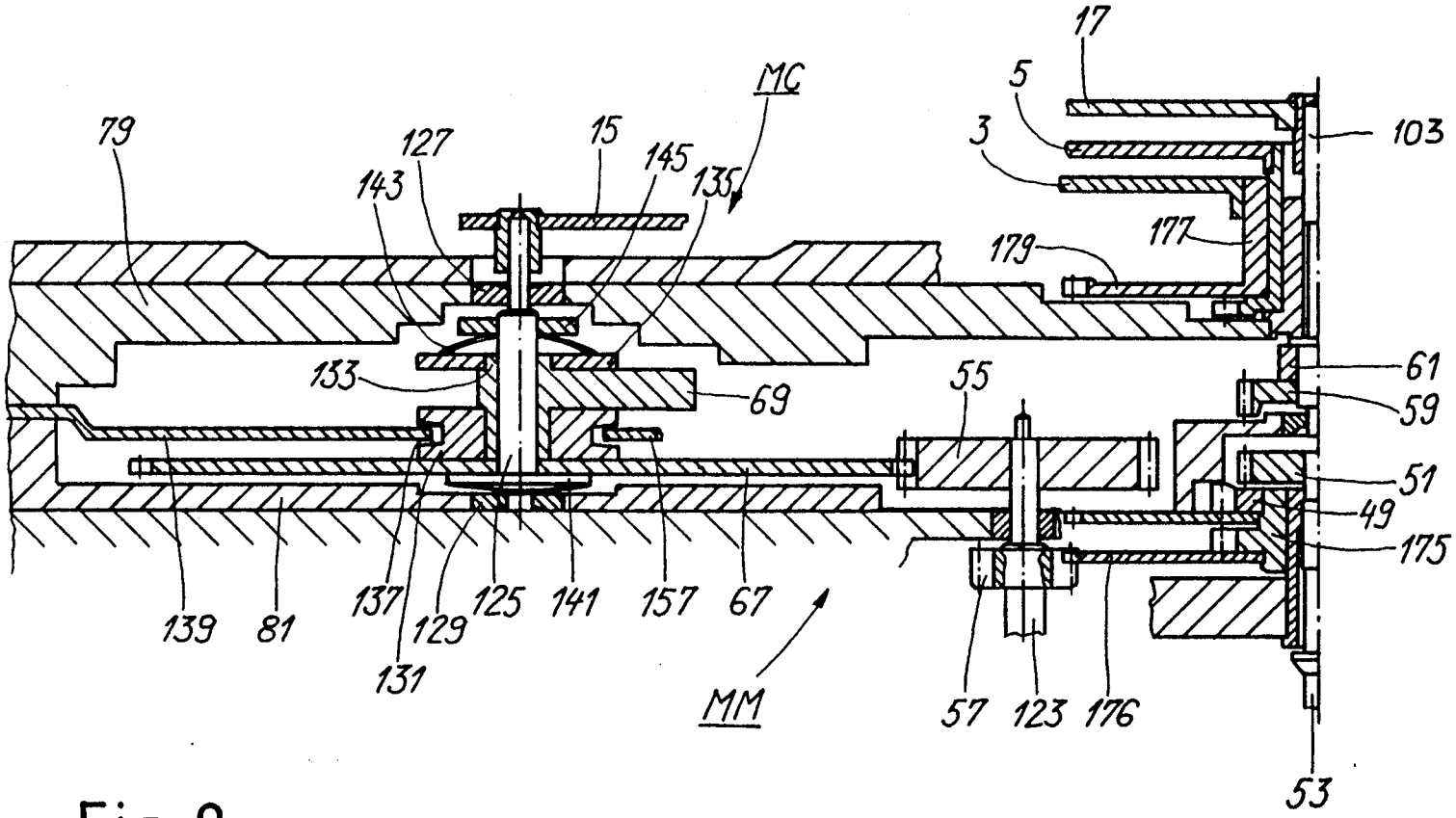
FIGS. 8 and 9 are sectional views along the line VIII—VIII of FIG. 14 showing two extreme positions capable of being occupied by a further coupling wheel.

As may be seen in FIG. 8, the axle 123 of the third wheel 57 of the motor module MM is extended in the direction of the chronograph module MC. The intermediate toothed wheel 55 of the minute hand is driven onto this axle 123 and constitutes the third power take off previously described. This toothed wheel 55 meshes with the minute counter wheel 67. This latter is freely mounted on a minute counter axle 125 bearing the hand 15.

This axle 125 is mounted in two bearings 127, 129 provided in the chronograph bar 79 and in the chronograph plate 81 respectively. The wheel 67 of the minute counter is surmounted by a hub 131 driven on a bush of the heart-piece 69 of the minute counter slidably mounted on the axle 125.

In its upper part, the heart-piece 69 also has a shoulder 133 about which a disk 135 is engaged. The hub 131 has an annular recess 137 constituting an engagement groove for an uncoupling lever 139 which will be described hereafter. The heart-piece 69, the hub 131 and the disk 135 are capable of sliding along the axle 125 under the action of the uncoupling lever 139 in order to assume two positions.

In the engaged position (lower position shown in FIG. 8), the minute counter wheel 67 is tightened and locked by friction between a plate 141 provided on the axle 125 and the hub 131 and it transmits its movement of rotation to the axle 125 which drives the hand 15 of the minute counter.

In the unengaged position (upper position, shown on FIG. 9), the hub 131 is slightly displaced upwards, but the wheel 67 of the minute counter continues to be engaged with the intermediate wheel 55 of the minute counter without transmitting its movement to the axle 125 and thus to the hand 15. In this case, the wheel 67 consequently turns freely about the axle 125.

It will be noted that the hub 131 is resiliently urged downwards to come into contact with the wheel 67 of the minute counter due to a resilient washer 143 pressed between a platform 145 driven onto the axle 125 and the disk 135 so that the hub 131 and the wheel 67 are normally engaged.

The hub 131 is driven by the uncoupling lever 139 of the minute counter which is best seen on FIGS. 3 to 5 and 14. This lever 139 has an elongated shape and has at one of its extremities two brackets 147 and 149 which are provided with orifices designed to receive two studs 151 and 153 riveted onto the chronograph plate 81. The uncoupling lever 139 is thus positioned by these two studs 151 and 153 and is pressed between the chronograph bar and the plate 81 (see FIGS. 8 and 9). It also has a palette 155 at its other extremity and a lateral fork 157 in its median portion. As may be seen in FIGS. 8 and 9, this fork 157 penetrates the engagement groove 137 and makes it possible to lift the hub 131. The palette 155 is vertically displaced by the uncoupling control 121, as will be described hereinbelow.

Figure 9:
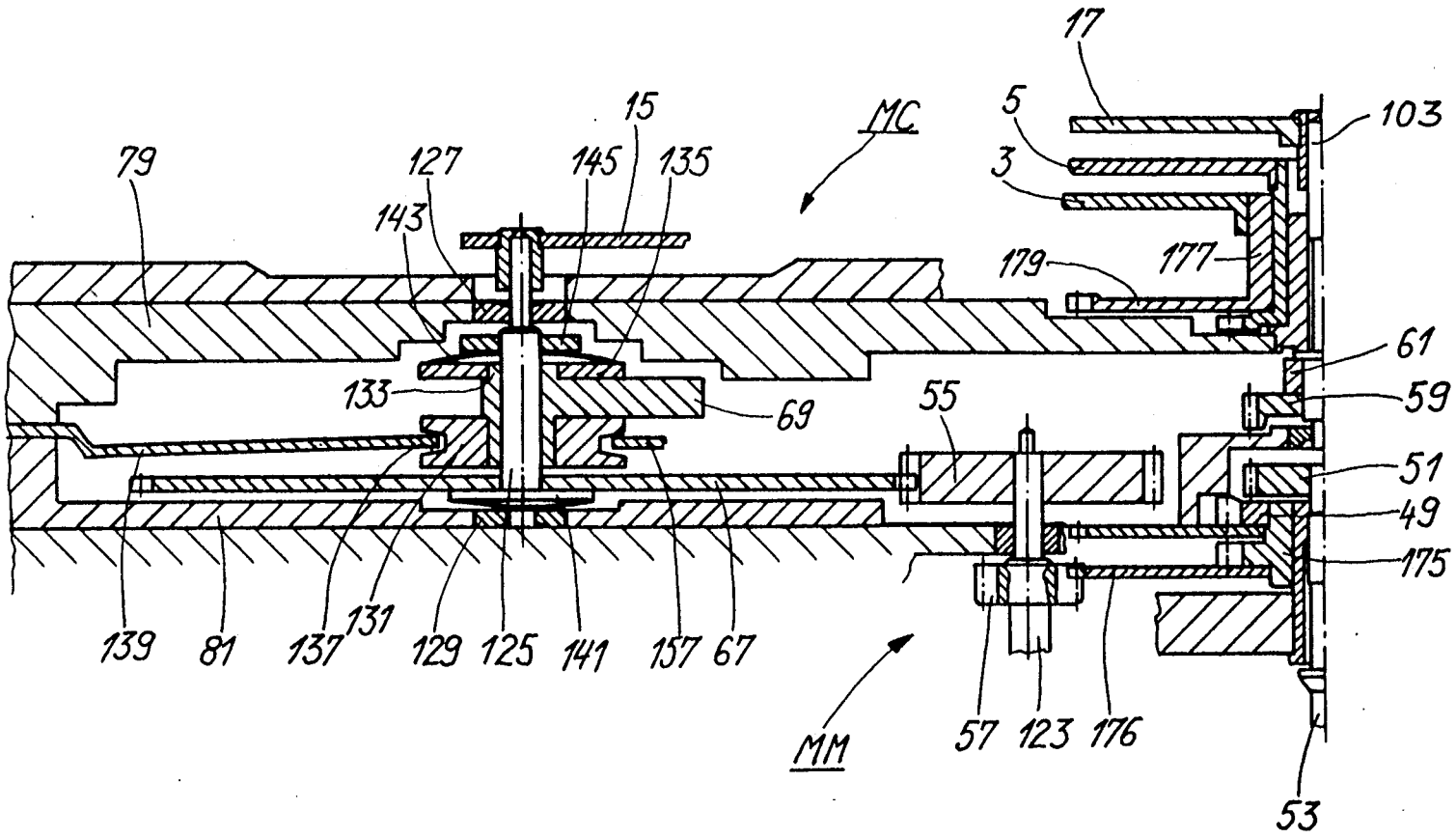
Figure 10:
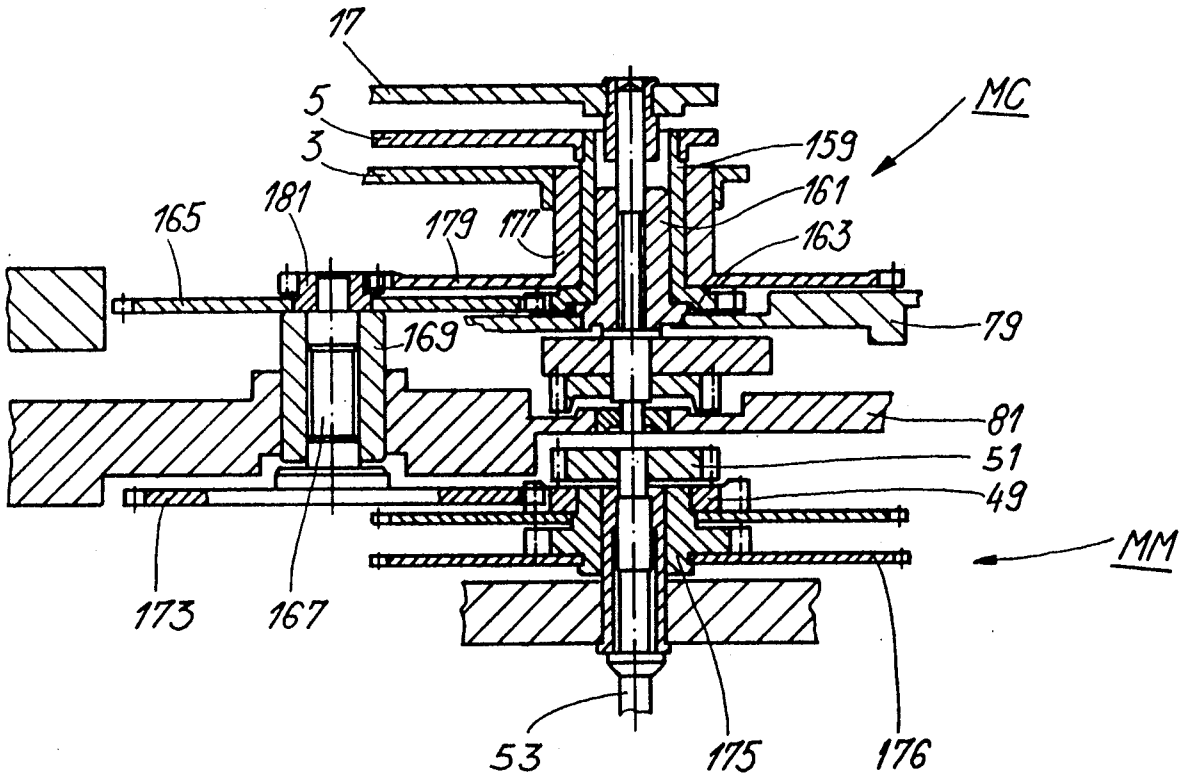
FIG. 10 is a sectional view along the line X—X of FIG. 14 showing the centre of the module of the invention.

The minute hand 5 (FIG. 10) is fixed to a cannon-pinion 159 of the chronograph module MC pivotally mounted on a fixed cannon-pinion 161 carried by the bar 79. This cannon-pinion 159 has in its lower part a pinion 163 which meshes with a dial-train wheel 165. This latter is fixed to an axle 167 pivoted in a sleeve 169 fixed in the chronograph plate 81. This axle 167 has at its lower extremity an intermediate cannon-pinion wheel 173 which meshes with the wheel 49 constituting the first power take off. This wheel 49 is fixed to the cannon-pinion 175 of the motor module MM. In addition, the cannon-pinion 175 of the motor module MM is engaged with the third wheel 57 by means of a plate 176 as shown in FIG. 9.

In addition, the hour hand 3 is fixed to the bush 177 of the hour wheel 179 concentrically to the cannon-pinion 159 of the chronograph module. The hours wheel 179 meshes with a pinion 181 fixed to the dial-train wheel 165.

Figure 12:
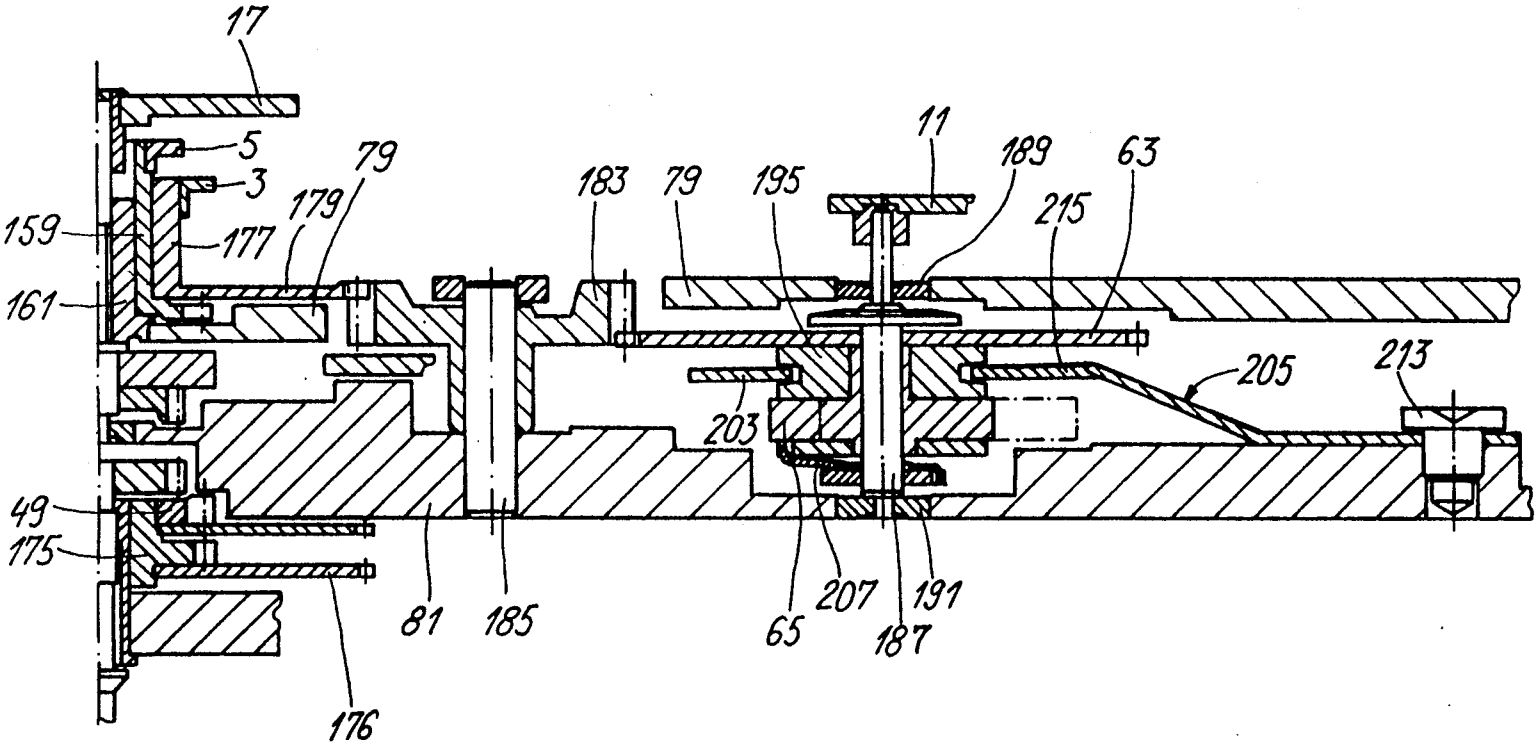

As may be seen from FIGS. 11 and 12, the wheel 63 of the hour counter is driven from the hours wheel 179 by a return wheel 183 freely revolving about an axle 185 driven in the chronograph plate 81. The wheel 63 of the hour counter turns freely about an axle 187 of the hour counter pivotally mounted in bearings 189, 191. These bearings 189, 191 are driven into the chronograph bar 79 and into the chronograph plate 81 respectively.

Figure 16:
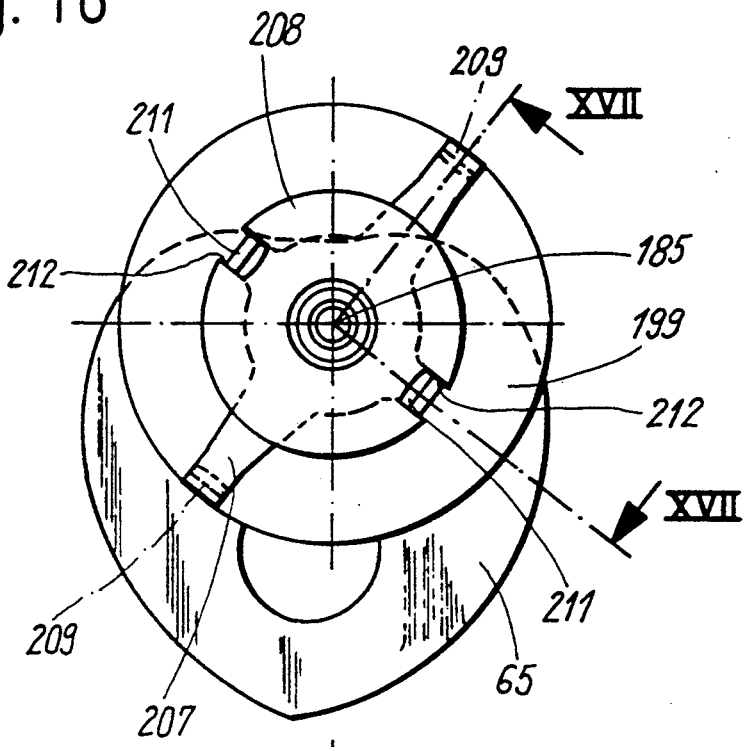
FIG. 16 shows an enlarged view along the arrow XVI of FIG. 11.
Figure 17:
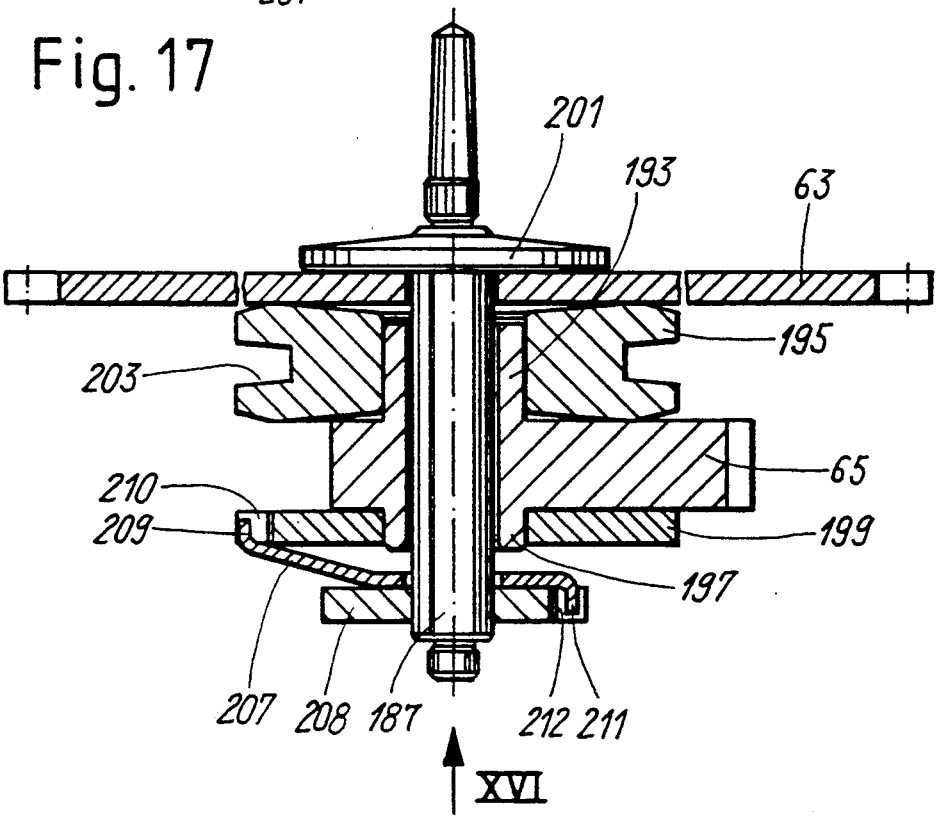
FIG. 17 shows an axial section along the line XVII—XVII of FIG. 26.

The return to zero heart-piece 65 of the hour counter is slidably mounted on the axle 185 and has on its upper face a bush 193 (see FIGS. 16 and 17) about which a hub 195 is engaged. The heart-piece 65 also has, on its lower face, a shoulder 197 about which a recessed disk 199 is engaged. The wheel 63 of the hour counter is placed about the hub 195 and is retained by a plate 201 formed on the axle 187. The hub 195 has an annular groove 203 into which an uncoupling lever 205, to be described hereinbelow, is engaged (FIGS. 11 and 12).

The heart-piece 65, the hub 195 and the disk 199 are slidably mounted on the axle 187 by the action of the uncoupling lever 205 so as to occupy two positions.

In the engaged position (upper position shown in FIGS. 11 and 17), the wheel 63 of the hour counter is locked by friction between the plate 201 and the hub 195 to transmit its movement of rotation to the axle 187 which drives the hand 11 of the hour counter.

In the unengaged position (lower position shown in FIG. 12), the hub 195 is slightly displaced towards the bottom, but the wheel 63 of the hour counter continues to mesh with the return wheel 183 without nevertheless transmitting its movement of rotation to the axle 187 because it then turns freely thereabout.

The assembly is normally engaged by the action of a resilient wafer 207 retained on the axle 185 by a recessed stop washer 208. The resilient wafer 207 has two drive catches 209 folded upwards and engaging in the recesses 210 of the disk 199. It also has two catches 211 folded downwards and engaged in the recesses 212 of the stop washer 208. In this manner the heart-piece 65 rotates together with the shaft 187 while still being able to slide axially in relation thereto when the uncoupling lever 205 displaces the hub 195 towards the bottom against the resilient action of the wafer 208.

Figure 15:
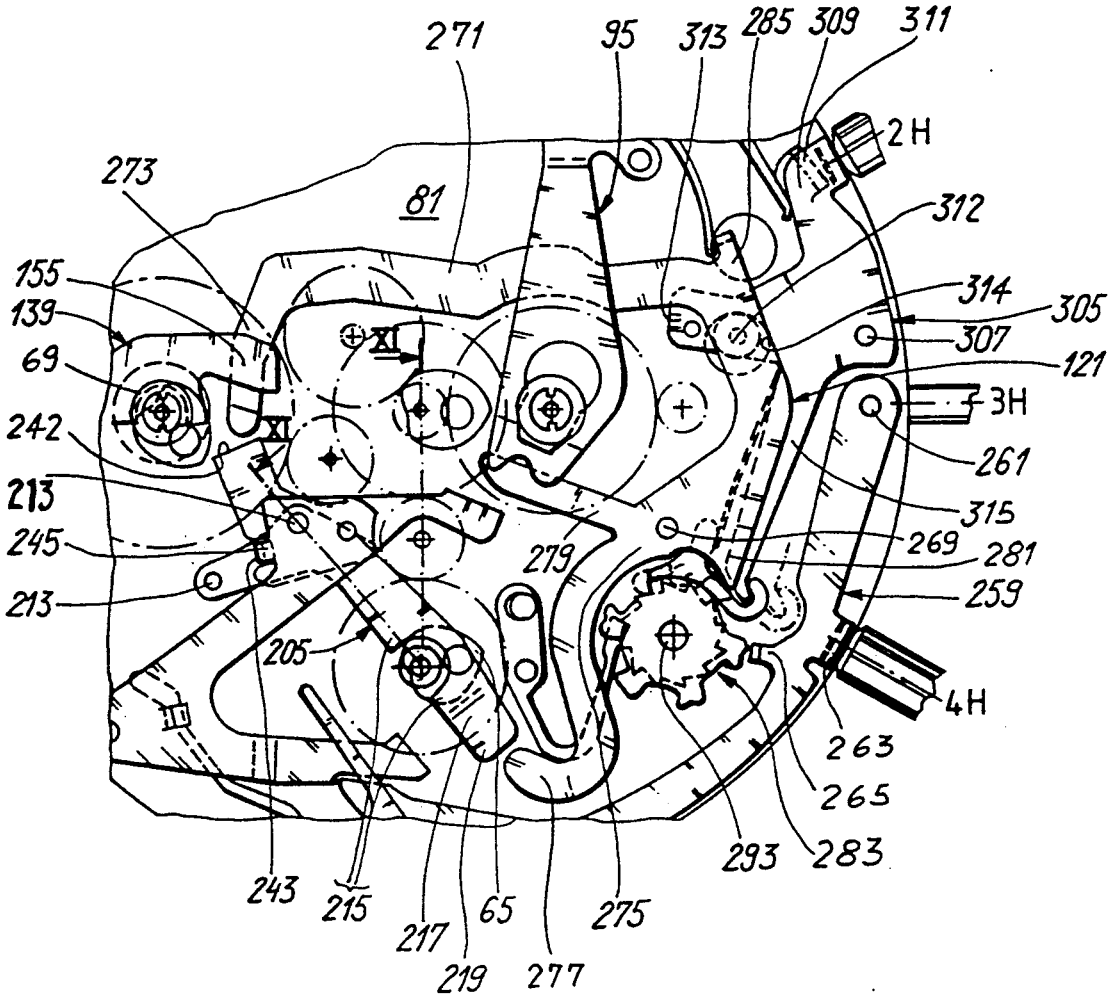

The uncoupling lever 205 is clearly visible on FIGS. 3 and 15. It is L-shaped and is fixed to the chronograph plate 81 by its small branch by means of two screws 213. A lateral fork 215 is provided in its median part which penetrates the engagement groove 203 and makes it possible to displace the hub 195 vertically. At its free extremity 217, this uncoupling lever 205 has a downwards directed inclined plane 219 which cooperates with the uncoupling control 121 as will be described hereinbelow.

The chronograph wheel 59, the minute counter 13 and the hour counter 9 are returned to zero by means of their corresponding heart-pieces 61, 69, 65 on which a chronograph hammer 221 acts.

Figure 14:
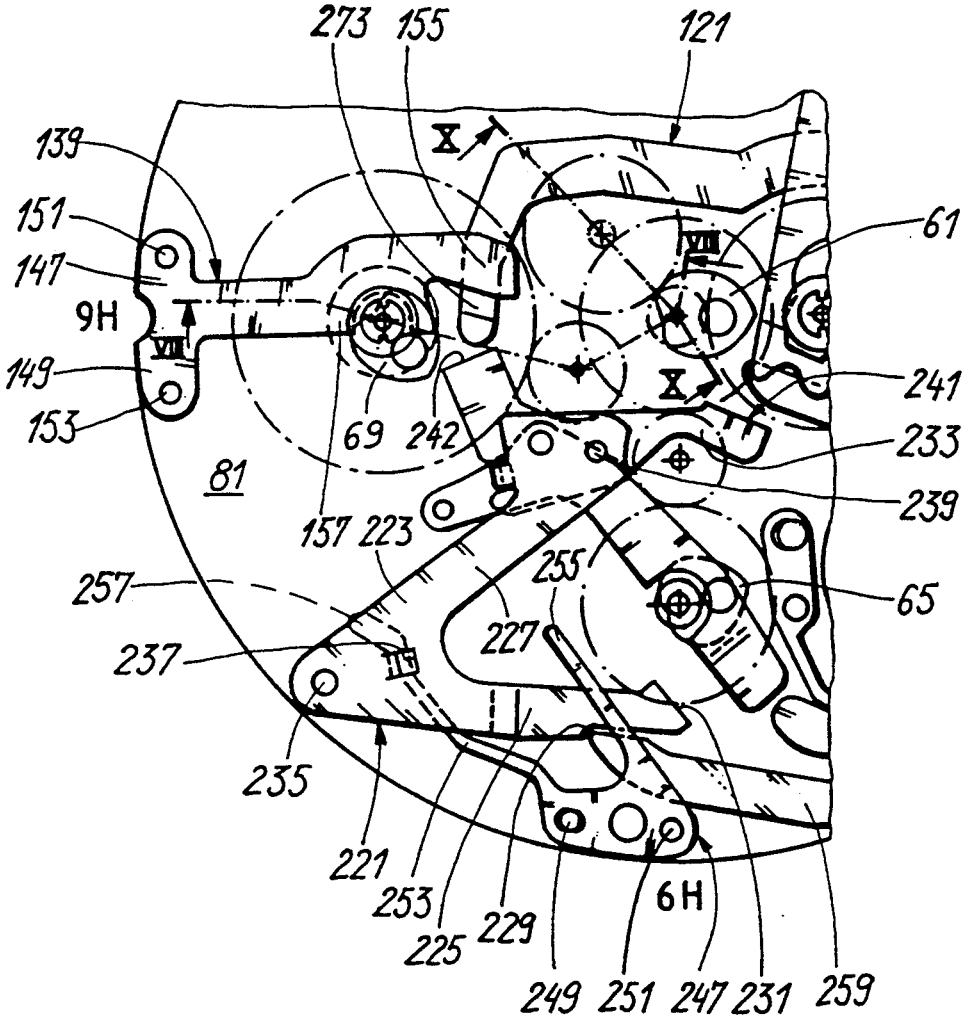

FIG. 14 shows that this chronograph hammer 221 comprises two parts assembled together. The first part 223 has two control branches 225, 227 arranged in a V. The first branch 225 has a notch 229 at one of its lateral edges and ends in a sloping portion 231 adapted to cooperate with the heart-piece 65 of the hour counter. The second branch 227 has at its free extremity the second part 233 of the chronograph hammer forming the peen of the hammer. The first part 223 is articulated about a pivot 235 and also has a downwards facing beak 237 in its central area. The peen of the hammer 233 is arranged below the first part 233 and fixed thereto by a rivet 239 which allows it some freedom of rotation in relation to the first part 223. The peen of the hammer 233 has a first inclination 241 adapted to cooperate with the heart-piece 61 of the chronograph wheel and a second inclination 242 adapted to cooperate with the heart-piece 69 of the minute counter.

The peen of the hammer 233 also has an opening 243, whereas the first part 223 has a beak 245 directed vertically downwards, this beak being introduced in the opening 243 when the two parts 223, 233 are assembled (see FIG. 15). The width of the beak 245 is less than that of the opening 243 so that there is a slight lateral play between the parts 223 and 233, which allows them a slight angular clearance in relation to one another about the rivet 239 so as to eliminate backlash during the return to zero.

The chronograph hammer 221 can occupy two positions. In the first position illustrated in FIGS. 3, 4 and 14, the hammer 221 is in a rest position. It is maintained in this position by a hammer spring 247 fixed to the plate 81 by two screws 249, 251 presenting a substantially V shape, that is two resilient branches 253, 255. The branch 253 of this spring of the hammer cooperates with the beak 237 and has a retaining head 257 at its extremity. The branch 255 passes above the chronograph hammer 221 and prevents this from rising.

In the second position illustrated in FIG. 5, the chronograph hammer 221 has turned about the pivot 235 and the inclinations 231, 241 and 242 bear respectively against the heart-pieces 65, 61 and 69 to return them to their original position. The chronograph hammer 221 is displaced in this second position by a return-to-zero lever 259.

This is articulated at one of its extremities about a pivot 261 (FIG. 15) located at 3 o'clock and comprises on its outer edge (turned towards the outside of the chronograph module) a palette 263 (FIG. 18) folded at a right angle towards the bottom and on which the push button 4 can act. It also has a beak 265 on its inner edge, substantially opposite this palette 263. Its free extremity is provided with a control head 267 (FIGS. 3 to 5) adapted to cooperate with the notch 229 of the chronograph hammer 221.

The uncoupling lever 95 of the chronograph hub 91 and the uncoupling levers 205 and 139 of the hubs 195 and 131 of the hour and minute counters are actuated by the uncoupling control 121 made of a single part as shown in FIGS. 3, 4 and 5, its details being most clearly visible on FIG. 15.

The uncoupling control 121 is articulated about a pivot 269 and is approximately V-shaped. A first branch 271 of this control 21 has a free extremity oriented at a right angle towards the inside of the V where it presents an upwards directed inclined plane 273. This inclined plane 273 is adapted to cooperate with the extremity 155 of the uncoupling lever 139 of the minute counter.

The second branch 275 (see FIG. 18) of this uncoupling control 121 is slightly curved inwards and its free extremity 277 shaped like a question mark cooperates with the extremity 217 of the uncoupling lever 205 of the hour counter. This second branch 275 has protuberances 279, 281 on both sides. The first 279 forms a control arm of the uncoupling lever 95 of the chronograph hub 91 and the second 291 forms the control beak adapted to cooperate with a cam 283 which will be described hereinbelow.

Finally, this uncoupling control 121 has at the point of the V a beak 285 (FIG. 15) subjected to the action of a spring 287 which is most clearly visible on FIGS. 3, 4 and 5 and which will described hereinbelow. This spring angularly urges the coupling control 121 in such a manner than the control beak is in contact with the cam 283.

The cam 283 (FIG. 18) is a mobile pivoting about an axle 293 and is provided with six shoulders 295. A ratchet 297, coaxial and fixed to the cam 293 is fixed thereunder. This ratchet 297 has twelve triangular teeth 299 and it is subjected to the action of a jumper 301.

The rotation of the cam 283 is effected by means of a control organ 303 which acts on the ratchet 297. It is itself subjected to the action of a start and stop lever 305. This part 303 is maintained vertical by the cam 283.

The start and stop lever 305 (see also FIG. 15) is articulated about a pivot 307 and has three arms. A first arm 309 has an extremity folded downwards at a right angle in order to define a palette 311 on which the push-button 2H can act. A second arm 313 is directed towards the centre of the chronograph module and passes under the uncoupling control 121. This second arm 313 has an upwards directed slug 213 on its upper surface. This slug 213 passes through a circular orifice 314 provided in the chronograph plate (not visible on FIG. 15). This slug 312 and this orifice 314 make it possible to limit the angular displacement of the start and stop lever 305 against the action of the spring 287. A third arm 315 is provided at its extremity with a guide head 317 (FIG. 18) cooperating with the part 303 constituting the rotation control.

The start and stop lever 305 is also subjected to the action of the spring 287 described hereinabove.

The part 303 constituting the rotation control has three arms, a first arm 319 presenting a curved extremity which surrounds the guide head 317, a second arm 321 constituting a hook and acting on the triangular teeth 299 of the ratchet 297 to drive this in rotation and a third arm 323 subjected to the action of a return spring 325. This spring 325 comprises a resilient blade fixed in the plate 81 or in the lever 305 at one of its extremities, the other extremity of which rests on the arm 323.

Figure 13:
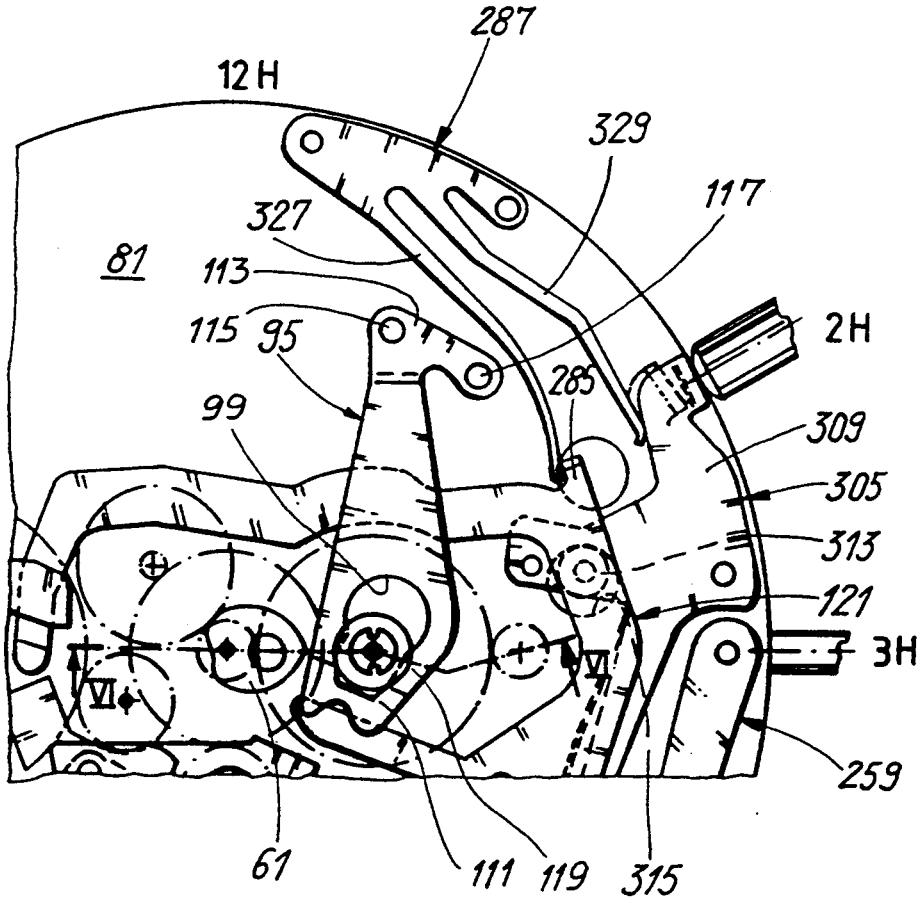
FIGS. 13, 14 and 15 are detailed enlarged views of FIG. 3 showing parts of the chronograph module.

The spring 287 is visible in FIG. 13. It has two tapered resilient arms 327 and 329. The arm 327 acts on the beak 285 of the uncoupling control 121 whereas the arm 329 acts on the first arm 309 of the start and stop lever 305.

The operation of the chronograph watch of the invention will now be described in greater detail and by describing the three successive stages in a complete control cycle.

OPERATION OF THE CHRONOGRAPH

This operation is actuated when the user exerts pressure on the push-button 2H. The elements of the chronograph which had been in the position shown in FIG. 4 return to the position shown in FIG. 3.

Figure 18:
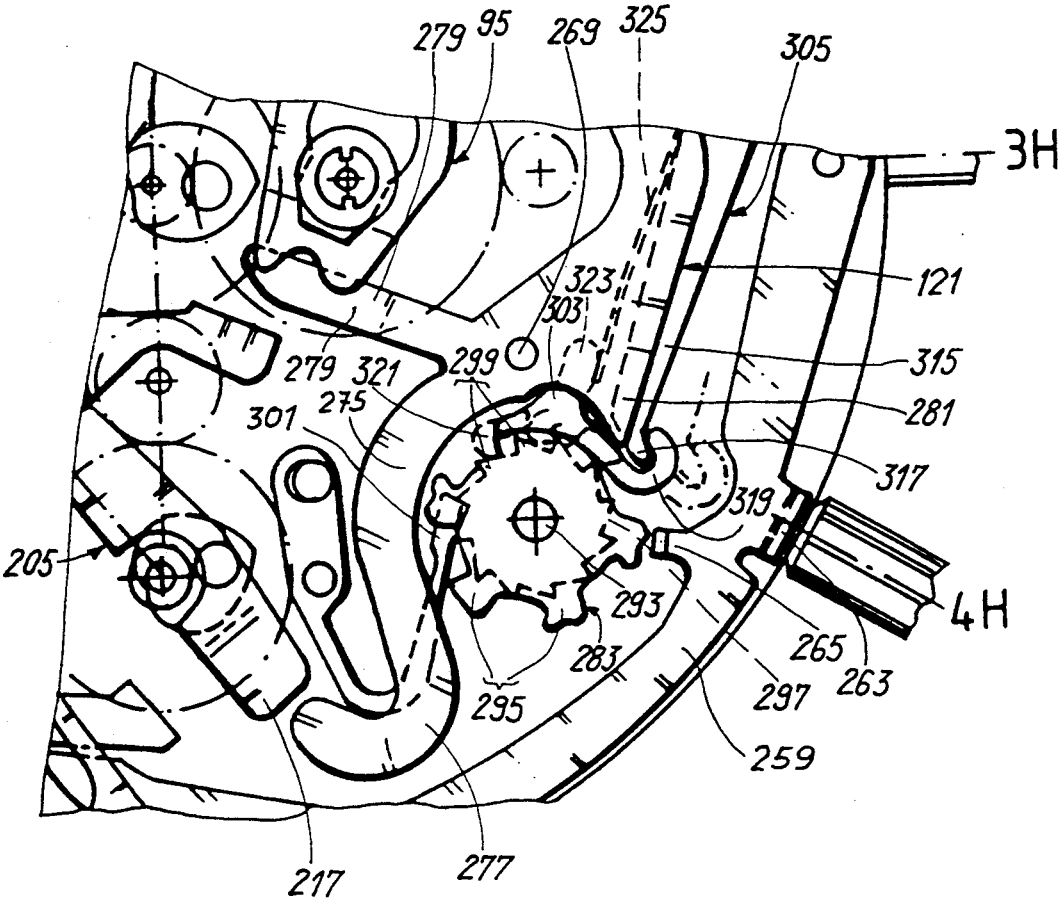
FIG. 18 is an enlarged view of part of the view of FIG. 15.

The user exerts pressure on the push-button 2H the effect of which is to cause the start and stop lever 305 to pivot, as shown in broken lines in FIG. 3, in such a way that the guide head 317 (FIG. 18) moves the part 303 constituting the rotation control. The hook 321 then drives the cam 283 in rotation (FIG. 18). The control beak 281 of the uncoupling control 121 which was initially located between two neighbouring gates 295 is lifted onto one of the gates 295 (FIG. 18). This causes the uncoupling control 121 to pivot about the axle 269.

The extremity 277 of the control 121 which pushed against the extremity 217 of the uncoupling lever 205 (FIG. 4) moves away therefrom (FIG. 3). Then, as illustrated in FIG. 12, this lever 205 is released so that the resilient washer 207 can act and engage the hub 195 against the wheel 63 of the hour counter (see FIG. 11). The hand 11 of the hour counter begins to turn.

Simultaneously the protuberance 279 of the uncoupling control 121 which was located under the inclined plane 111 of the uncoupling lever 95 (FIG. 4) moves away therefrom (FIG. 3).

Figure 7:
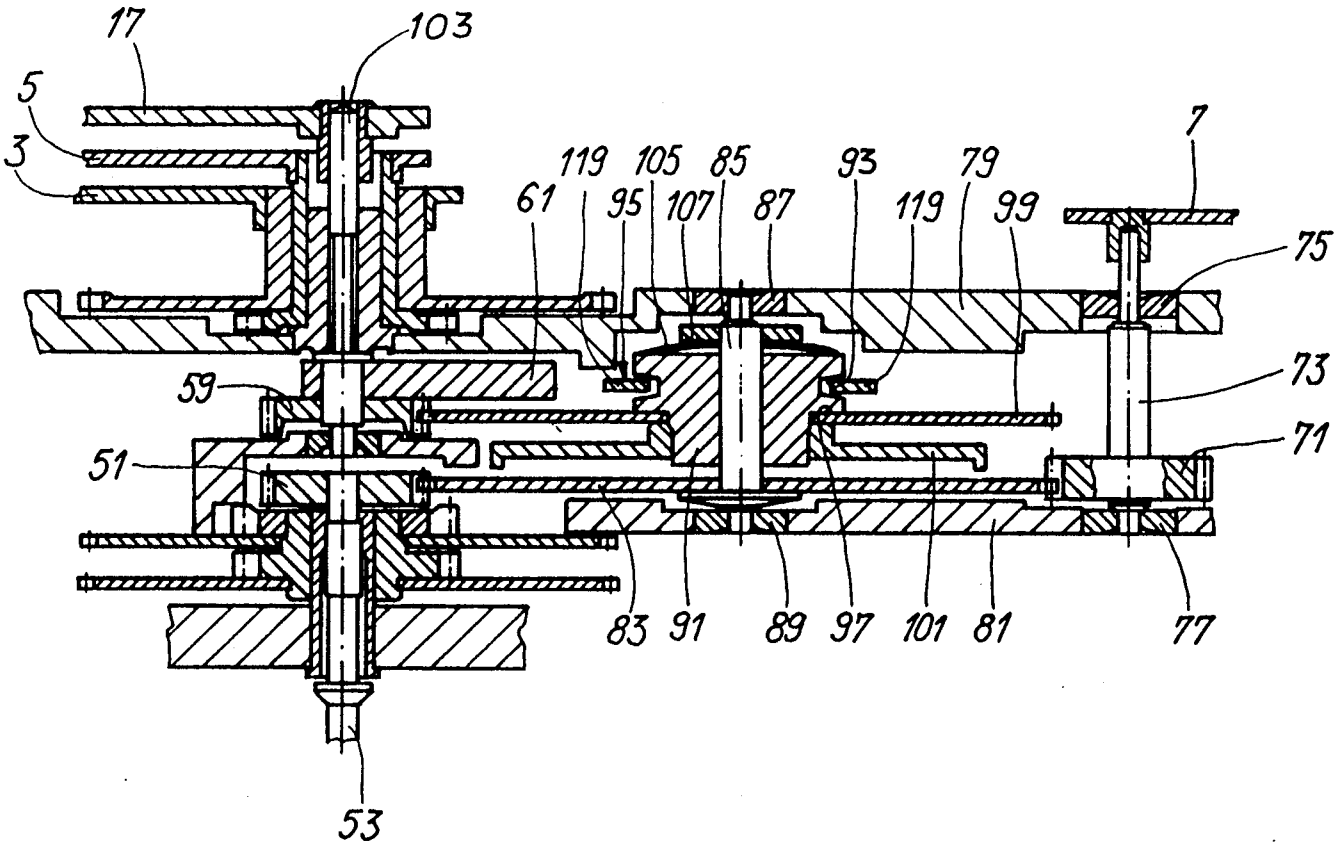

Next, as illustrated in FIG. 7, the hub 91 on which the uncoupling lever 95 acts is subjected to the action of the resilient washer 105. When the extremity of the uncoupling lever 95 is no longer supported, the hub 91 lowers itself by the action of the resilient washer 105 so that the coupling wheel 99 engages with the intermediate seconds wheel 83. The central second hand 17 begins to turn.

Also in simultaneous manner, the inclined plane 273 the upper extremity of which was under the extremity 155 of the uncoupling lever 139, maintaining the latter in an elevated position (position shown on FIG. 4) engages under this lever 139 which permits its extremity 155 to lower itself down (position shown in FIG. 3).

This has the effect of lowering the hub 131 which displaces itself along the axle 125 and leaves the position shown in FIG. 9 to pass to that shown in FIG. 8. The minute counter is then put into action and the hand 15 begins to turn.

STOPPING THE CHRONOGRAPH

The operations that will now be described also take place simultaneously. The chronograph is in the operating position shown in FIG. 3. When the user exerts a second pressure on the push-button 2H, the elements of the chronograph move to return to the position shown in FIG. 4. The start and stop lever 305 had returned to its initial position (position shown in solid lines) after the first pressure on the push-button 2H, due to the branch 329 of the spring 287 (see FIG. 13).

By the action of the push-button 2H, the start and stop lever 305 moves as before so that the hook 321 causes the cam 283 to move forward by one step. The control beak 281 of the uncoupling control 121 then falls into the hollow between two adjacent steps (FIG. 18). This causes the pivoting of the uncoupling control 121 and returns it to the position in FIG. 4. The active extremities of the uncoupling levers 205, 139 and 95 move in the direction opposite to that already described, the wheels of the various counters are unengaged and the hands 11, 15 and 17 are halted.

RETURNING THE CHRONOGRAPH TO ZERO

During this operation the elements of the chronograph pass for a short instant from the position of FIG. 4 to that of FIG. 5 and then return to the position of FIG. 4. The return to zero is effected by pressure exerted on the push-button 4H which acts on the return-to-zero lever 259. The latter moves angularly about the pivot 261 and its free extremity constituting the control head 267 acts on the notch 229 of the chronograph hammer 221. This notch 229 causes the resistance perceived by the user to be overcome. The chronograph hammer 221 then turns about the pivot 235. At the end of the stroke, the hammer 235, or more specifically the inclinations 241, 242 and 231, fall on the heart-pieces 61, 69 and 65 respectively (see FIG. 14) which return to their original position. The central second hand 17, the hand of the minute counter 15 and the hand of the hour counter 11 are thus returned to zero.

The return to zero of the heart-pieces is caused by the force exerted by the user on the push-button 4H. In contrast, as soon as the user releases the pressure on this push-button 4H, the branch 253 of the spring 247 returns the chronograph hammer 221 to the position shown in FIG. 4, this hammer returning the lever 259 to its initial position.

It should be noted that in the chronograph operating position (FIG. 3) it is not possible to effect the. return to zero because the beak 265 of the return-to-zero lever 259 is opposite a shoulder 295.

It will be noted that all the levers and other control organs of this chronograph module, such as the hammers, the coupling control, the start and stop lever, etc. are made of stamped metal sheets, the operation being completed by a folding operation where appropriate.

I claim:

1. A watch movement comprising a combination of a chronograph module and a motor module, the motor module comprising a third wheel, a first power take off composed of a toothed wheel integral with a cannon-pinion and a second power take off composed of a pinion fixed to a seconds axle in the centre, the chronograph module comprising a chronograph hand, a hand for a minute counter and a hand for an hour counter, said watch movement comprising a third power take off composed of a wheel fixed to the third wheel, these three power take offs being accessible from the same side by the upper face of the motor module and the chronograph module being placed against said upper face of the motor module and in that the hand of the chronograph, the hand for the minute counter and the hand for the hour counter are driven respectively and in independent manner by said second, third and first power take offs.

2. A watch movement according to claim 1 wherein a chronograph wheel driving the chronograph hand is mounted in series with a coupling wheel and an intermediate seconds wheel driven by the second power take off.

3. A watch movement according to claim 1 wherein a wheel of the minute counter driving the hand of the minute counter is mounted in series directly with the third power take off.

4. A watch movement according to claim 1 wherein a wheel of the hour counter is successively mounted in series with a return wheel, an hours wheel, a dial-train mobile and the first power take off.

5. A watch movement according to claim 1 wherein a coupling mechanism is interspersed in each kinematic chain leading from said first, second and third power take offs respectively to the corresponding hands and in that each of these coupling mechanisms has an uncoupling lever simultaneously actuated by one and the same control organ when the chronograph is put into operation.

* * * * *